US010392137B2

(12) United States Patent
Catellani

(10) Patent No.: US 10,392,137 B2
(45) Date of Patent: Aug. 27, 2019

(54) FOLDING UNIT FOR PRODUCING PACKAGES OF FOOD PRODUCTS POURABLE INTO A TUBE OF PACKAGING MATERIAL FROM SEALED PACKS

(71) Applicant: TETRA LAVAL HOLDINGS & FINANCE S.A., Pully (CH)

(72) Inventor: Andrea Catellani, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 386 days.

(21) Appl. No.: 15/128,555

(22) PCT Filed: Feb. 19, 2015

(86) PCT No.: PCT/EP2015/053470
§ 371 (c)(1),
(2) Date: Sep. 23, 2016

(87) PCT Pub. No.: WO2015/144363
PCT Pub. Date: Oct. 1, 2015

(65) Prior Publication Data

US 2018/0170587 A1 Jun. 21, 2018

(30) Foreign Application Priority Data

Mar. 25, 2014 (EP) ..... 14161399

(51) Int. Cl.
*B65B 3/02* (2006.01)
*B65B 7/20* (2006.01)
(Continued)

(52) U.S. Cl.
CPC ..... *B65B 3/025* (2013.01); *B65B 7/04* (2013.01); *B65B 7/20* (2013.01); *B65B 43/10* (2013.01);
(Continued)

(58) Field of Classification Search
CPC ..... B31B 50/26; B31B 50/48; B31B 50/58; B65B 7/20; B65B 35/22; B65B 35/205;
(Continued)

(56) References Cited

U.S. PATENT DOCUMENTS 2,868,356 A * 1/1959 Haaff ..... B65G 23/14 198/833
3,146,566 A 9/1964 Roth
(Continued)

FOREIGN PATENT DOCUMENTS

EP 0 887 261 A1 12/1998
EP 1 785 355 A1 5/2007
(Continued)

OTHER PUBLICATIONS

International Search Report (PCT/ISA/210) dated Apr. 8, 2015, by the European Patent Office as the International Searching Authority for International Application No. PCT/EP2015/053470.
(Continued)

*Primary Examiner* — Andrew M Tecco
*Assistant Examiner* — Amelia Jae-Ippel Vorce
(74) *Attorney, Agent, or Firm* — Buchanan Ingersoll & Rooney PC

(57) ABSTRACT

A folding unit for producing packages from sealed packs having at least one flap to be folded, the folding unit including a conveying device carrying at least one pushing element arranged for interacting with the at least one flap, and a supporting element onto which the conveying device abuts when the at least one pushing element interacts with the at least one flap. The conveying device also includes at least one rolling element rolling onto the supporting element.

15 Claims, 7 Drawing Sheets

(51) Int. Cl.

| | |
|---|---|
| ***B65B 43/10*** | (2006.01) |
| ***B65B 51/10*** | (2006.01) |
| ***B65B 51/18*** | (2006.01) |
| ***B65B 61/24*** | (2006.01) |
| ***B65B 7/04*** | (2006.01) |

(52) U.S. Cl.
CPC ..... *B65B 51/10* (2013.01); *B65B 61/24* (2013.01); *B65B 51/18* (2013.01)

(58) Field of Classification Search
CPC ..... B65B 35/36; B65B 35/38; B65B 35/58; B65B 43/10; B65B 43/48; B65B 43/42; B65B 51/144; B65B 5/06; B65B 5/105; B65B 21/18; B65B 21/20; B65B 57/10; B65B 57/14; B65B 65/02; B65B 2220/18; B25J 9/0093; B25J 9/1687; B25J 15/0061; B65G 47/905; B65G 47/907; B65G 47/918; B65G 15/14; B65G 15/16
USPC ..... 493/68, 70, 80, 127, 162, 196, 423; 53/377.2, 234; 198/370.08, 597, 626.1, 198/832, 833
See application file for complete search history.

(56) References Cited

U.S. PATENT DOCUMENTS

| | | | | |
|---|---|---|---|---|
| 4,034,537 | A | 7/1977 | Reil et al. | |
| 4,614,079 | A * | 9/1986 | Ida | B65B 3/025 53/372.3 |
| 5,001,891 | A * | 3/1991 | Abate | B29C 65/18 156/583.5 |
| 5,966,899 | A | 10/1999 | Fontanazzi | |
| 6,412,624 | B1 * | 7/2002 | Lundin | B65B 43/54 198/803.14 |
| 7,331,441 | B2 * | 2/2008 | Persson | B65B 35/205 198/370.08 |
| 9,309,055 | B2 * | 4/2016 | Pedretti | B65B 43/52 |
| 2011/0073444 | A1 * | 3/2011 | Wunsch | B65G 23/16 198/833 |
| 2012/0245008 | A1 * | 9/2012 | Florentzson | B65B 61/24 493/162 |
| 2014/0371046 | A1 * | 12/2014 | Catellani | B65B 51/20 493/162 |

FOREIGN PATENT DOCUMENTS

| | | | | |
|---|---|---|---|---|
| EP | 1785355 | A1 * | 5/2007 | B29C 65/3656 |
| EP | 2 631 188 | A1 | 8/2013 | |
| WO | WO 2011/065884 | A1 | 6/2011 | |

OTHER PUBLICATIONS

Written Opinion (PCT/ISA/237) dated Apr. 8, 2015, by the European Patent Office as the International Searching Authority for International Application No. PCT/EP2015/053470.

* cited by examiner

FOLDING UNIT FOR PRODUCING PACKAGES OF FOOD PRODUCTS POURABLE INTO A TUBE OF PACKAGING MATERIAL FROM SEALED PACKS

TECHNICAL FIELD

The present invention relates to a folding unit for producing packages of food products pourable into a tube of packaging material from sealed packs.

BACKGROUND OF INVENTION

As is known, many food products, such as fruit juice, pasteurized or UHT (ultra-high-temperature treated) milk, wine, tomato sauce, etc., are sold in packages made of sterilized packaging material.

A typical example of this type of package is the parallelepiped-shaped package for liquid or pourable food products known as Tetra Brik Aseptic (registered trademark), which is made by folding and sealing laminated sheet packaging material.

The packaging material has a multilayer structure substantially comprising a base layer for stiffness and strength, which may comprise a layer of fibrous material, e.g. paper, or of mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH), which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material; the web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating; and the web of packaging material so sterilized is maintained in a closed, sterile environment, and is folded and sealed longitudinally to form a vertical tube.

Packaging machines comprise a forming unit, wherein the tube is filled continuously downwards with the sterilized or sterile-processed food product, and is sealed and then cut along equally spaced cross sections to form pillow packs, which are then fed to a folding unit to form the finished, e.g. substantially parallelepiped-shaped packages.

More specifically, the pillow packs substantially comprise a parallelepiped-shaped main portion; and a top end portion and a bottom end portion, opposite to each other and projecting laterally on opposite sides of the main portion and defining respective triangular end flaps to be folded onto the main portion.

A longitudinal sealing strip, formed when sealing the packaging material to form the vertical tube, extends along the pillow packs; and the top end portion and bottom end portion of each pillow pack have respective transverse sealing strips perpendicular to the longitudinal sealing strip and defining respective end flaps projecting from the top and bottom of the pack.

The top end portion and the bottom end portion of each pillow pack taper towards the main portion from the respective end flaps, and are pressed towards each other by a folding unit of the packaging machine to form flat opposite end walls of the pack, while at the same time folding the end flaps onto respective walls of the main portion.

Folding units are known, for example from EP-1726526, substantially comprising a chain conveyor for feeding packs continuously along a predominantly straight horizontal forming path from a supply station to an output station, and a plurality of folding devices which cooperate cyclically with each pack along the forming path to flatten the respective top end portion and bottom and portion of the pack and so fold the respective end flaps onto the end portions.

The folding unit comprises heating means arranged for heating the packs and melting the plastic material forming the outer plastic layer of the packs at the top end portion and bottom end portion.

One of the above-mentioned folding devices comprises a pressing unit arranged above the chain conveyor so as to interact with the packages. The pressing unit presses the end flaps onto the respective walls of the main body and, as the plastic material sets, the end flaps are sealed to the walls of the main body.

The pressing unit comprises a belt having the shape of a loop and provided with a lower branch arranged to interact with the packs to press the end flaps. The pressing unit comprises a driving element which drives the belt so that the rotation of the belt is synchronized with the movement of the chain conveyor.

The pressing unit further comprises a plate, facing toward the chain conveyor, on which the lower branch of the belt slides when the belt is rotated. In practice, the plate prevents the belt from moving away from the packages during mutual interaction, so allowing the belt to exert the required pressure on the end flaps.

The belt further comprises a plurality of bulges, projecting from the belt towards the chain conveyor and having a shape substantially matching with the end zone of the pack they have to push. The bulges are spaced along the belt so that each bulge interacts with a corresponding pack being advanced by the chain conveyor.

Though reliable and efficient, the folding units described still leave room for further improvement.

A drawback of the folding unit is that the pressing unit has to be equipped with a cooling system for dissipating the heat produced by the friction, since the belt slides on the plate at a high speed. The metal body forming the plate, therefore, has to be provided with channels, or pipes, for a cooling fluid.

Another drawback of the folding unit is that the belt—due to the interaction with the plate—becomes worn after a certain number of working hours and has to be replaced.

The above-mentioned drawbacks are magnified in case of packaging machines having an increased output rate, which means correspondingly increased speeds of the chain conveyor and of the belt of the pressing unit.

DISCLOSURE OF INVENTION

An object of the present invention is to improve the folding units for folding packs.

Another object of the invention is to provide a folding unit that may be used with high speed filling machines.

Another object of the invention is to provide a folding unit in which the devices that pushes the end flaps of the packs are less subjected to wear.

According to the present invention, there is provided a folding unit for producing packages of food product pourable into a tube of packaging material from sealed packs, as claimed in claim 1.

BRIEF DESCRIPTION OF THE DRAWINGS

Some preferred, non-limiting embodiments of the present invention will be described by way of example with reference to the accompanying drawings, in which.

DETAILED DESCRIPTION OF PREFERRED EMBODIMENTS

With reference to FIGS. 1 to 7 there is disclosed a folding unit 1 for a packaging machine (not shown) for continuously producing sealed packages 2 of a pourable food product, such as pasteurized or UHT milk, fruit juice, wine, etc., from a known tube of packaging material (not shown).

The tube is formed in known manner upstream from the folding unit 1 by longitudinally folding and sealing a known web (not shown) of heat-seal sheet material which may comprise a base layer for stiffness and strength, which may be formed by a layer of fibrous material, e.g. paper, or of mineral-filled polypropylene material, and a number of layers of heat-seal plastic material, e.g. polyethylene film, covering both sides of the base layer. In the case of an aseptic package 2 for long-storage products, such as UHT milk, the packaging material may also comprise a layer of gas- and light-barrier material, e.g. an aluminium foil or an ethyl vinyl alcohol (EVOH) foil, which is superimposed on a layer of heat-seal plastic material, and is in turn covered with another layer of heat-seal plastic material forming the inner face of the package 2 eventually contacting the food product.

The tube of packaging material is then filled with the food product, and is sealed and cut along equally spaced cross sections to form a number of packs 3, having a pillow-like shape, which are then transferred to the folding unit 1 where they are folded mechanically to form respective packages 2, having a substantially parallelepiped-shape.

Alternatively, the packaging material may be cut into blanks, which are formed into packages 2 with forming spindles, and the packages 2 are filled with the food product and sealed. One example of this type of package is the so-called "gable-top" package known by the trade name Tetra Rex (registered trademark).

Figure 5:
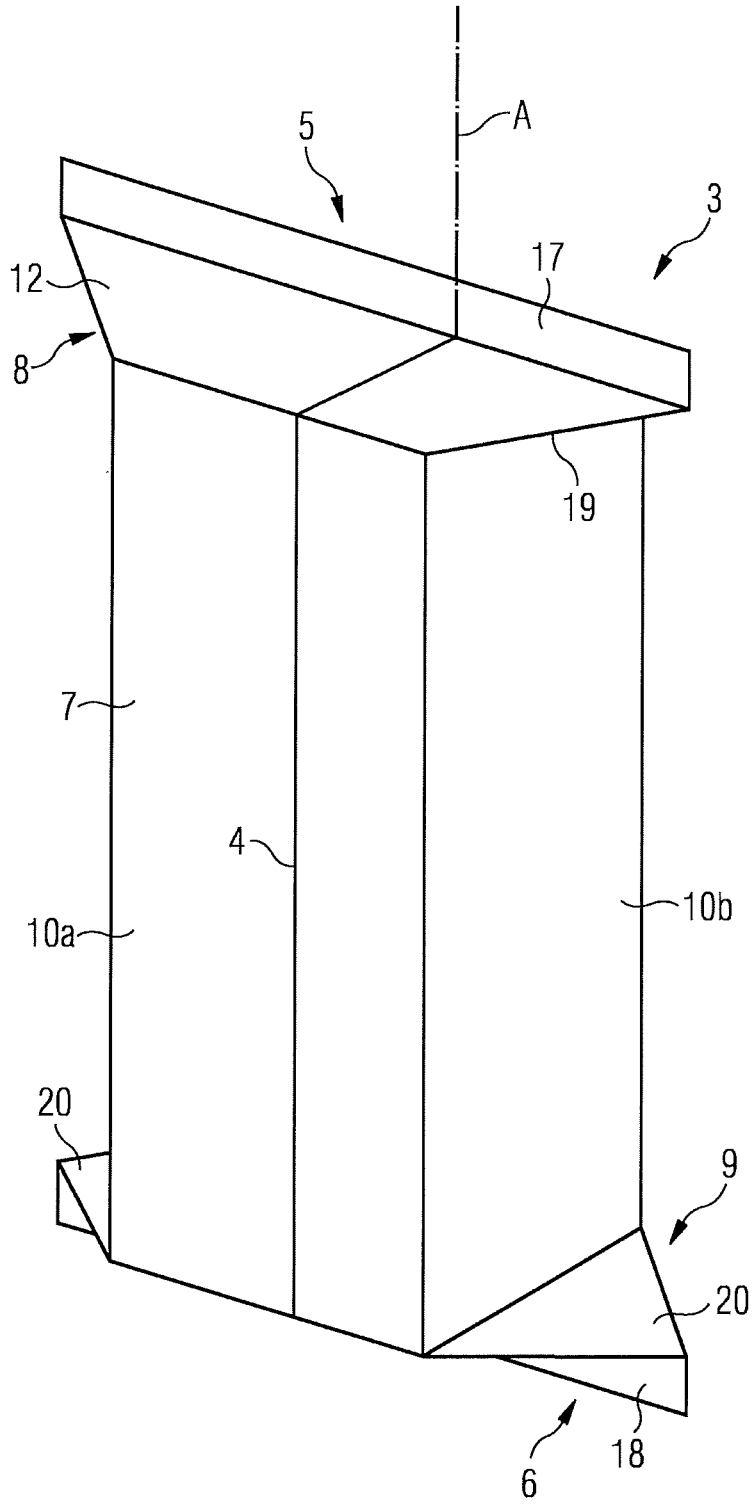
FIG. 5 is a side view in perspective of a pack to be folded with the folding unit of FIG. 1.

With reference to FIG. 5, an embodiment of a pack is shown which has a longitudinal sealing band 4, formed to produce the tube of packaging material from the web folded into a cylinder, extends along one side of the pack 3, which is closed at opposite ends by a first transversal sealing band 5 and a second transversal sealing band 6 perpendicular to and joined to the longitudinal sealing band 4.

Each pack 3 has an axis A, and comprises a main body 7, a first end portion 8 and a second end portion 9 tapering from the main body 7 towards the respective first transverse sealing band 5 and second transverse sealing band 6.

The main body 7 of the pack 3 is bounded laterally by two first lateral walls 10*a* and two second lateral walls 10*b* which are alternate to each other.

The first end portion 8 and the second end portion 9 are each defined by two walls 12, each substantially in the form of an isosceles trapezium, which slope slightly towards each other with respect to a plane perpendicular to axis A, and have minor edges defined by opposite edges of respective wall 10*a*, and major edges joined to each other by the respective first transversal sealing band 5 and second transversal sealing band 6.

The longitudinal sealing band 4 extends between the first transverse sealing band 5 and the second transverse sealing band 6, and along the whole of one wall 10*a* and the corresponding walls 12 on the same side as the wall 10*a*.

The first end portion 8 comprises a first substantially elongated rectangular end fin 17, formed by the first sealing band 5, and projecting in the direction of axis A from the pack 3; and two substantially first triangular flaps 19, projecting laterally on opposite sides of the main body 7, and defined by end portions of the walls 12 and by corresponding triangular end portions of the lateral walls 10*b*.

Similarly, the second end portion 9 comprises a second substantially elongated rectangular end fin 18, formed by the second sealing band 6, and projecting in the direction of axis A from the pack 3; and two substantially second triangular flaps 20, projecting laterally on opposite sides of the main body 7, and defined by end portions of the walls 12 and by corresponding triangular end portions of the lateral walls 10*b*.

More precisely, each of the first end fin 17 and the second end fin 18 extends along a direction orthogonal to axis A.

To form a package 2, the folding unit 1 presses the first end portion 8 and the second end portion 9 down flat towards each other, and at the same time folds the first end fin 17 onto the flattened first end portions 8 and the second end fin 18 onto the flattened second end portion 9.

Figure 6:
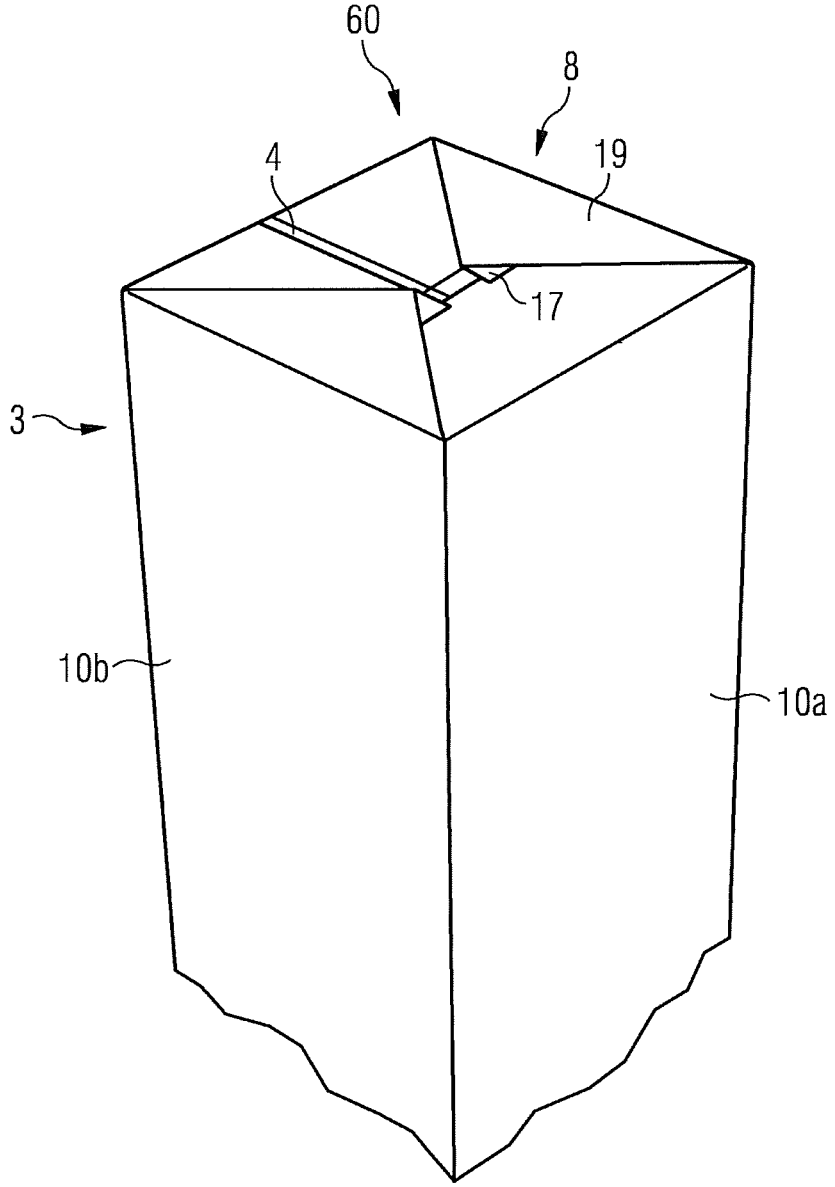
FIG. 6 is a partial side view in perspective of a package obtained by folding the pack of FIG. 5 using the folding unit of FIG. 1.

The folding unit 1 folds the second triangular flaps 20 onto top ends of respective walls 10*b* towards the first end portion 8 and—as shown in FIG. 6—folds the first triangular flaps 19 onto the previously folded first end fin 17, on the opposite side of the second end portion 9.

With reference to FIGS. 1 to 4, the folding unit 1 comprises an endless conveyor 23 for feeding packs 3 continuously along a forming path B from a supply station (not shown) to an output station (not-shown).

The folding unit 1 further comprises first folding means (not shown) which cooperate cyclically with each pack 3 to flatten the first end portion 8, fold the first end fin 17 onto the first end portion 8, and fold the first triangular flaps 19 onto the previously flattened first end portion 8 on the opposite side of the second end portion 9.

The folding unit 1 further comprises second folding means (not shown) for folding the second end fin 18 onto the flattened second end portion 9.

The folding unit 1 further comprises third folding means 21 for bending the second triangular flaps 20 towards the axis A and the first end portion 8.

The folding unit 1 also comprises a heating device (not shown) acting on the partially bent first triangular flaps 19 and second triangular flaps 20 to melt the external layer of the packaging material of the first triangular flaps 19 and the second triangular flaps 20 before they are pressed and sealed against the first end portion 8 and the second lateral walls 10*b* respectively.

The folding unit 1 further comprises a pressing device 22 cooperating with each pack 3 to hold the first triangular flaps 19 onto the flattened first end fin 17 as the first triangular flaps 19 cool.

The heating device is arranged upstream of the pressing device 22 along forming path B.

The endless conveyor 23 comprises an endless transport element, in the example shown a chain 24, forming a loop and comprising a plurality of mutually hinged rigid modules or links 25.

The chain 24 comprises a conveying branch 26, a return branch 27 substantially parallel to the conveying branch 26, and two curved C-shaped portions 28, which are positioned with their concavities facing each other and connect the conveying branch 26 and the return branch 27.

The conveying branch 26 and the return branch 27 are straight and horizontal in the embodiment shown. In this case, the conveying 26 branch is positioned above the return branch 27.

Each link 25 comprises a substantially flat plate 29 adapted to receive a relative pack 3, and a paddle 30, which projects from plate 29 and which cooperates with and pushes one of the first lateral walls 10*a* of the packs 3 to feed the packs 3 along path B.

In the embodiment shown, the third folding means 21 comprises a plurality of pairs of shells 70. Each pair of shells 70 is arranged onto a respective link 25. The shells 70 of each pair are advanced together along path B by the respective link 25 and are slidable on the respective link 25 along a direction perpendicular to path B.

In another embodiment, not shown, the third folding means are arranged in a fixed position and interact with the packs 3 as the packs 3 are advanced by the endless conveyor 23.

The pressing device 22 comprises a conveying device 31 provided with a chain conveyor 32 having a plurality of link elements 33.

The chain conveyor 32 is looped around a first sprocket 34 and a second sprocket 35. In the embodiment shown in FIGS. 1 to 4, the first sprocket 34 is connected to a motor 36 that rotates the chain conveyor 32 along an advancing direction D, the chain conveyor 32 being synchronized with the endless conveyor 23.

The pressing device 22 comprises pushing elements 37, carried by the chain conveyor 32 and arranged for pushing the first triangular flaps 19 onto the flattened first end fin 17 as the plastic layer of the packaging material forming the first triangular flaps 19 cools.

Each pushing element 37 is carried by a respective link element 33. In particular, the in the embodiments shown in FIGS. 1 to 4 and 7, the number of pushing elements 37 is one half of the number of the link elements 33, a pushing element 37 being arranged on every second link element 33 of the chain conveyor 32.

Figure 1:
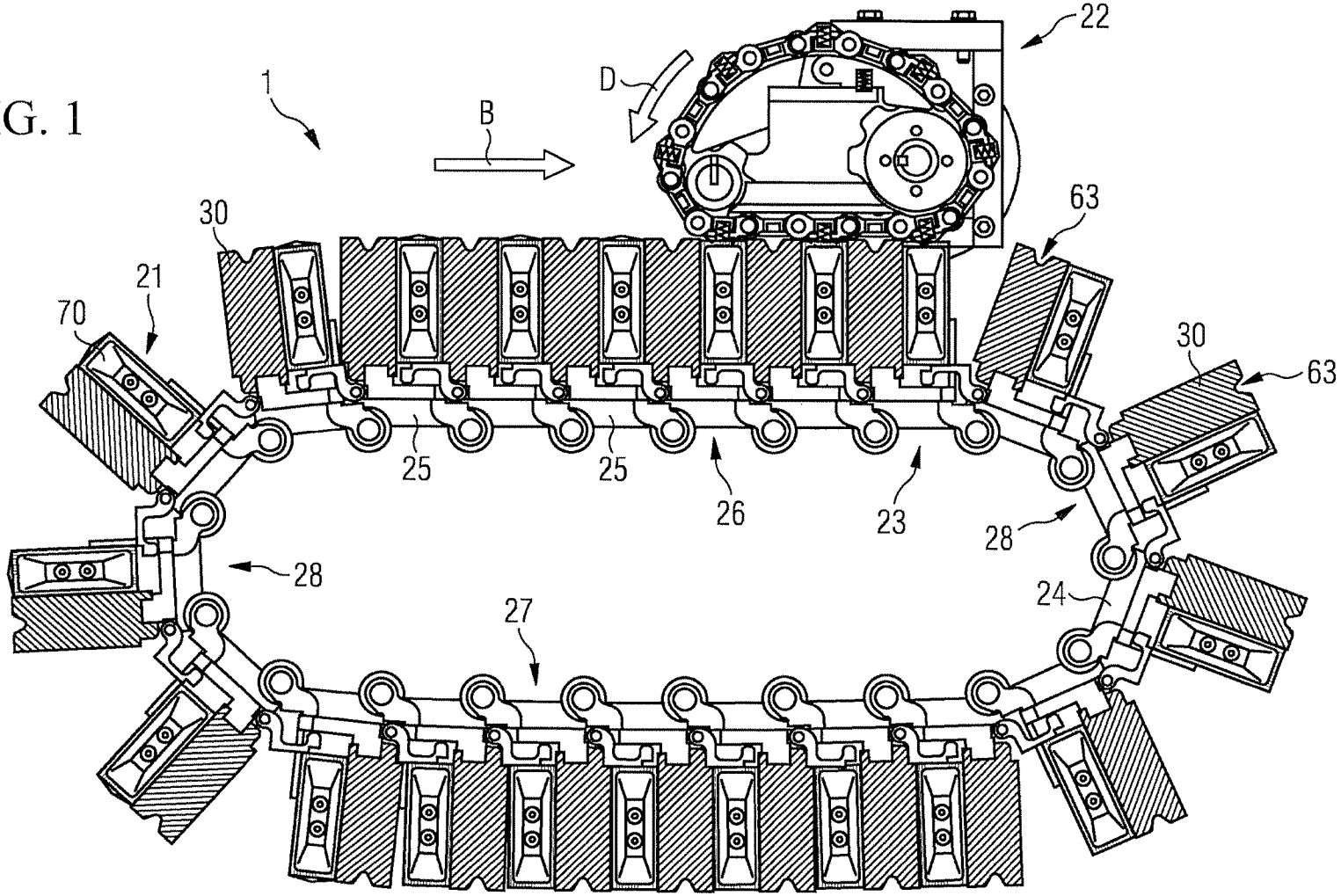
FIG. 1 is a schematic side view, partly sectioned and with parts removed for clarity, of a folding unit according to the present invention.
Figure 2:
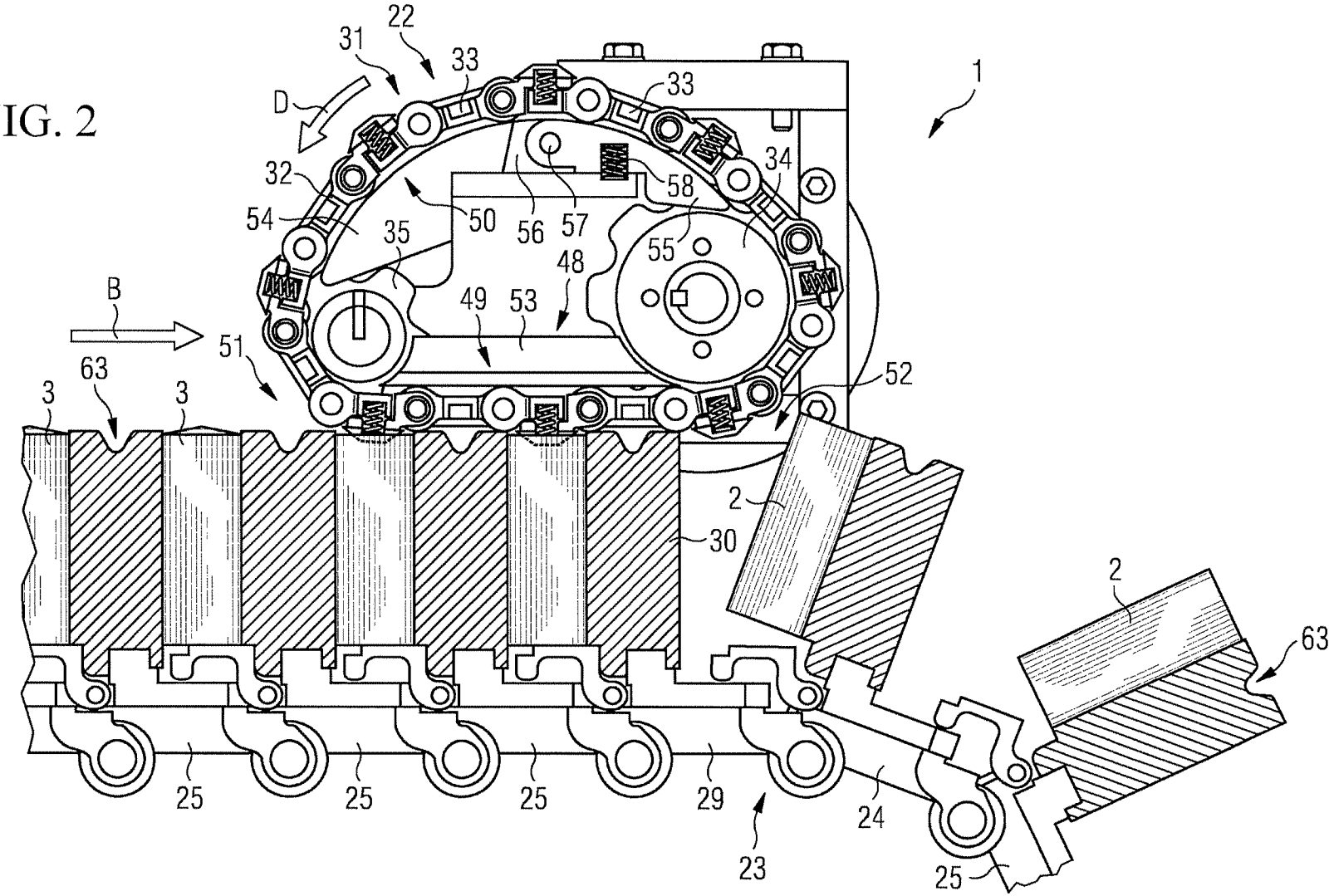
FIG. 2 is an enlarged detail of FIG. 1, with parts removed for clarity.
Figure 3:
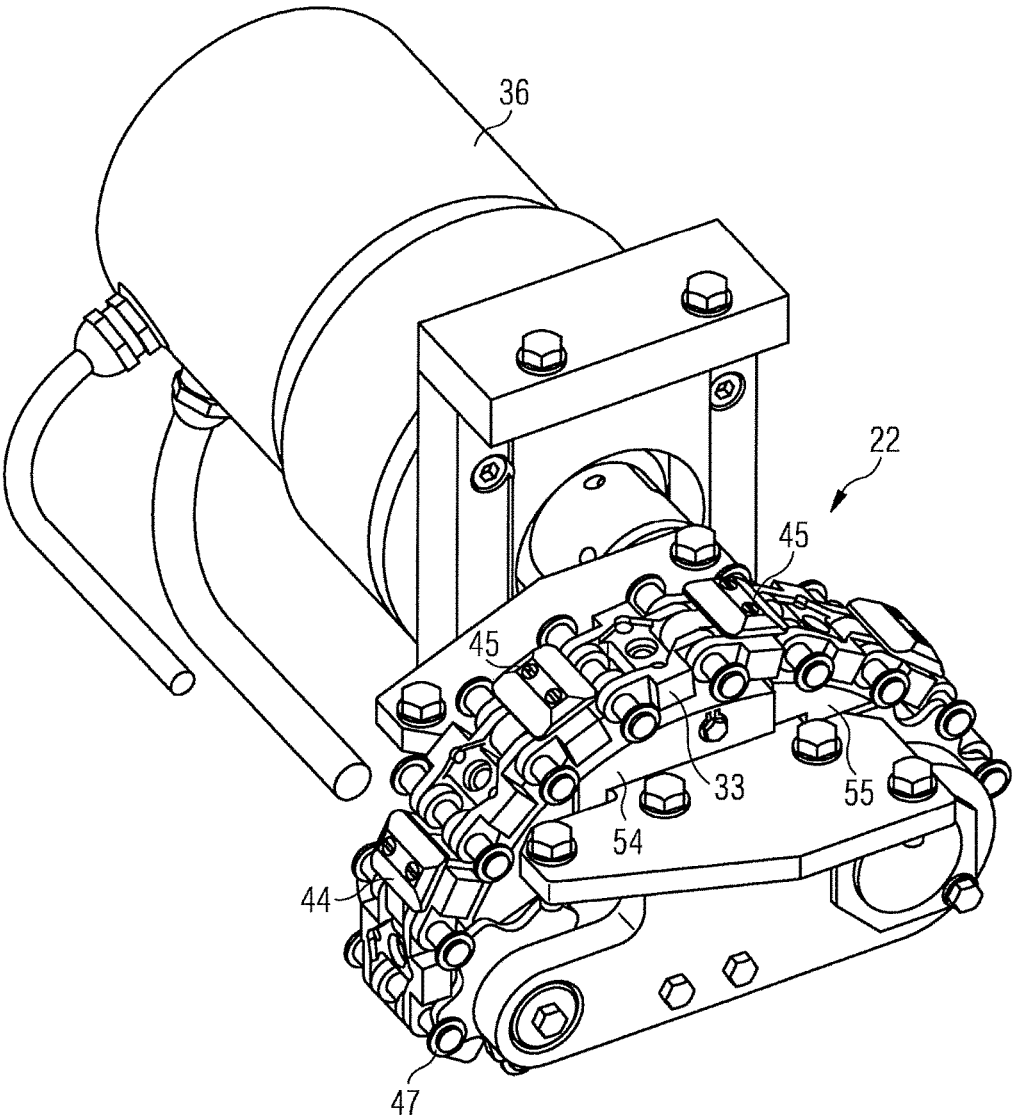
FIG. 3 is a side view in perspective of a pressing device of the folding unit of FIG. 1.
Figure 4:
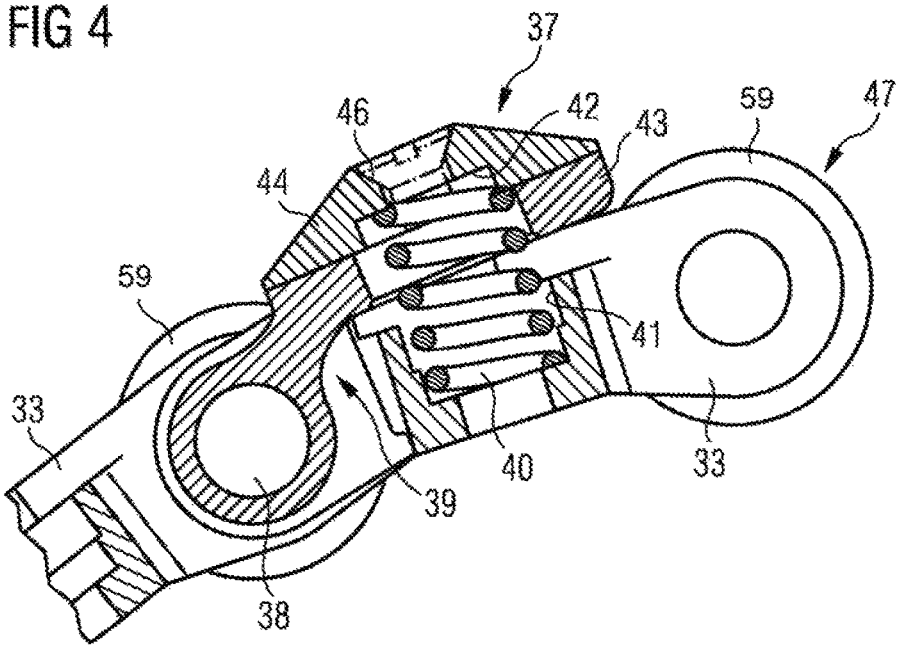
FIG. 4 is longitudinal section of a pushing element of the pressing device of FIG. 3.

With reference to FIG. 4, each link element 33 is hinged to the adjacent link element 33 by a pin 38.

The pushing element 37 is connected to the link element 33 and is movable with respect to the link element 33. In particular, the pushing element 37 comprises a body 39 hinged to the link element 33 through the pin 38.

A resilient element 40, for example a spring, is interposed between the link element 33 and the pushing element 37 to force the pushing element 37 away from the link element 33. The resilient element 40 is partly received into a seat 41 of the link element 33 and partly received into a recess 42 of the body 39. The body 39 comprises a supporting portion 43 hinged to the link element 33 and a bulge portion 44 projecting from the supporting portion 43. The bulge 44 portion is connected to the supporting portion 43 by means of fastening elements 45, for example screws passing through holes 46 of the bulge portion 44 and screwed to the supporting portion 43. By unscrewing the screws the bulge portion 44 may be removed from the supporting portion 43 so as to access the seat 41 and the recess 42 in order to remove—and replace—a resilient element 40, in case it is worn. In addition, the bulge element 44 may be replaced with another bulge element—having a different shape and/or size. In this way, the pressing device 22 may be used in connection with folding unit 1, and packaging machines, intended to form different kinds of packages.

The conveying device 31 comprises rolling elements 47 arranged for rolling onto a supporting structure 48 when the chain conveyor 32 is driven along the advancing direction D.

The rolling elements 47 comprise a plurality of rollers 59. The rollers 59 are hinged to the link elements 33 through the pins 38.

The chain conveyor 32 has an active branch 49 facing the endless conveyor 23 and extending—along the advancing direction D—from an inlet zone 51, where the pushing elements 37 starts interacting with the packs 3, to an outlet zone 52, where the pushing elements 37 are removed from the packages 2.

The chain conveyor 32 also has a return branch 50, facing away from the endless conveyor 23 and extending from the outlet zone 52 to the inlet zone 51.

The supporting structure 48 comprises a fixed supporting plate 53 arranged between the inlet zone 51 and the outlet zone 52—according to the advancing direction D—and facing towards the endless conveyor 23. The fixed supporting plate 53 is arranged to interact with the active branch 49. During operation of the machine, when the pushing elements 37 presses the packs 3, the rolling elements 47 rolls on the fixed supporting plate 53 and the fixed supporting plate 53 prevents the link elements 33 from moving away from the endless conveyor 23 and, therefore, from the packs 3. In this way, the pushing elements 37 may apply the right pressure onto the packs 3.

The supporting structure 48 further comprises a fixed supporting body 54 and a movable supporting body 55 arranged between the inlet zone 51 and the outlet zone 52—according to the advancing direction D—and facing away from the endless conveyor 23. The fixed supporting body 54 and the movable supporting body 55 are arranged to interact with the return branch 50.

The movable supporting body 55 is hinged through a pin element 57 to a fixed frame 56 of the folding unit 1 and is pushed towards the chain conveyor 32 by a spring 58. The movable supporting element 55 acts as a tensioning device for the chain conveyor 32.

During operation, the packs 3 are advanced by the endless conveyor 23. In particular, each pack 3 is received in the space defined by two consecutive paddles 30.

Upstream of the pressing device 22 the packs 3—whilst being moved by the endless conveyor 23 along path B—interact with the first folding means which flatten the first end portion 8, fold the first end fin 17 onto the first end portion 8, and start folding the first triangular flaps 19 onto the previously flattened first end portion 8 on the opposite side of the second end portion 9.

The packs 3 also interact with the heating device which acts on the partially bent first triangular flaps 19 to melt the external plastic layer of the packaging material of the first triangular flaps 19 before they are pressed and sealed against the first end portion 8.

Subsequently, the packs 3 reach the inlet zone 51 where the pushing member 37 interact with the packs 3 to press the first triangular flaps 19 onto the first end fin 17 and the first end portion 8 so as to define an end wall 60 of the package 2. In the embodiment shown, the packs 3 are advanced by the endless conveyor 23 in an "upside down" position and therefore the end wall 60 is a bottom wall of the package 2.

The pushing elements 37 are moved along the advancing direction D at the same speed as the packs 3 along path B. In this way, each pushing element 37 interacts with a corresponding pack 3.

In particular, the link elements 33 of the chain conveyor 32 which carry the pushing elements 37 face corresponding spaces, or compartments, defined by two consecutive paddles 30—and therefore the packs 3 received therein—whilst the link elements 33 of the chain conveyor 32 which do not carry the pushing elements 37 face the paddles 30.

The rolling elements 47 roll on the supporting structure 48. In particular, the rolling elements 47 roll on the fixed supporting plate 53 which acts as an abutting element for the rolling elements 47. The bulge portions 44—pushed by the resilient element 40—contact the packs 3 and make the first triangular flaps 19 adhere to the first end fin 17 and the first end portion 8.

In this way, the final packages 2 are obtained from the packs 3.

Subsequently, the packages 2 reach the outlet zone 52 where the pushing elements 37 are moved away from the packages 2.

Figure 7:
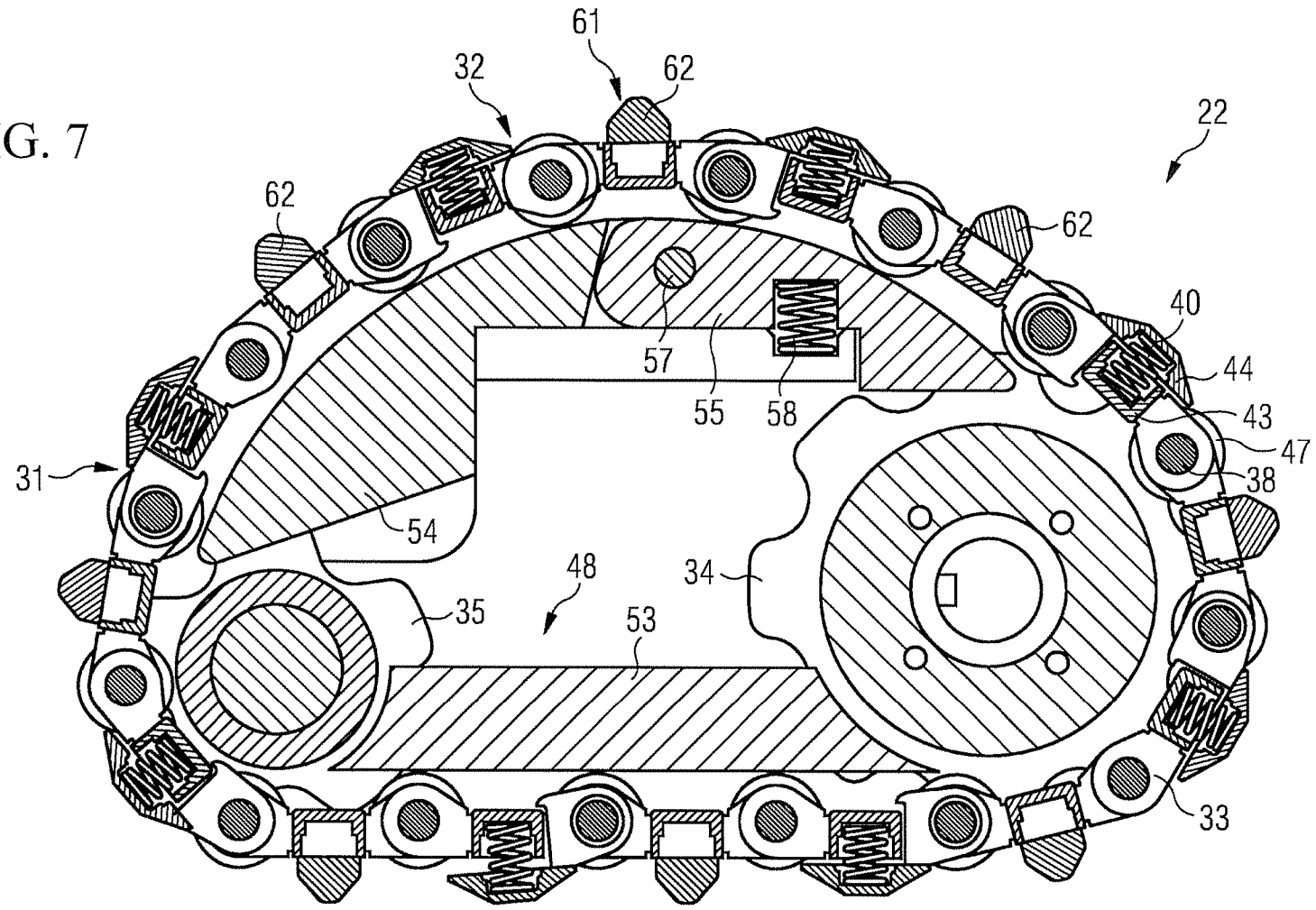
FIG. 7 is a longitudinal cross section of another embodiment of a pressing device of the folding unit according to the invention.

FIG. 7 shows another embodiment of the folding unit 1 according to the invention in which the pressing device 22 is provided with driving means 61 arranged for driving the conveying device 31 along the advancing direction D. In this embodiment, the folding unit 1 does not comprise the motor 36 and the first sprocket 34 and the second sprocket 35 are idle sprockets.

The driving means 61 comprises first driving means, in particular appendixes 62 projecting from the link elements 33, and second driving means, in particular cavities 63 (see FIGS. 1 and 2) of the paddles 30.

The appendixes 62 are so shaped as to engage with cavities 63.

In this way, the appendixes 62 mesh with the cavities 63 so as to rotate the conveying device 31.

The appendixes 62 extend from the link elements 33 which do not carry the pushing elements 37. In other words, the appendixes 62 and the pushing elements 37 are staggered on the link elements 33 of the chain conveyor 32.

The pitch at which the link elements 33 are arranged on the chain conveyor 32 is the same as the pitch at which the links 25 are arranged on the endless conveyor 23. In this way, each pushing element 37 interacts with a corresponding pack 3. In particular, each pushing element 37 interacts with only one pack 3 at a time. In other words, there is a dedicated pushing element 37 for each pack 3.

The advantages of the folding unit 1 according to the present invention will be clear from the foregoing description.

Owing to the rolling elements 47 the friction is highly reduced with respect to the known pressing units, in which the belt slides on the plate. In particular, owing to the invention, the sliding friction between the conveying device and the supporting structure is replaced by a rolling friction. In this way, a cooling system is not required. Moreover, the conveying device—being not subjected to a significant wear—does not need to be replaced, contrary to the belt of the known folding units.

In addition, the folding unit according to the invention may be used in combination with high speed filling machines since even at very high output rates there are no risks of wear and overheating.

In addition, the folding unit according to the invention allows obtaining a better forming of the packages since the pressing device 22 has a dedicated pushing element 37 for each pack 3. On the contrary, the belt of the known pressing units interacts with a group of packs (for example three) at the same time.

In this way, in case one of the packs of the group of packs is defective, or missing, the other packs of the group of packs are subjected to a higher pressure, which may damage such other packs.

In conclusion, according to the invention, all the packages are subjected to substantially the same forming pressure.

Moreover, the forming of the packages 2 is also improved due to the fact that the pushing element 37 are movable with respect to the conveying device 31 and, therefore, may better align and interact with the end wall 60 being formed. This is not possible in the known pressing units, in which the bulges are integral to the belt (in particular the bulges and the belt are made as a single piece).

In addition, the folding unit according to the invention is modular and can be used in connection with packaging machines intended to produce packages of various shapes and sizes. In this case, it is sufficient to remove the bulge portions 44 and replace them with bulge portions having the required geometry. On the contrary, with the known folding unit a dedicated belt is needed for each size and shape of the package.

Moreover, if the pressing device 22 is provided with the driving means 61, the folding unit 1 may be simplified by removing the motor 36.

Clearly, changes may be made to unit 1 without, however, departing from the protective scope defined in the accompanying claims.

The invention claimed is:

1. A folding unit for producing packages from sealed packs having at least one flap to be folded, said folding unit comprising:

a conveying device carrying at least one pushing element arranged for interacting with said at least one flap;

a supporting element onto which said conveying device abuts when said at least one pushing element interacts with said at least one flap;

said conveying device comprising at least one rolling element rolling onto said supporting element; and a main conveyor for advancing said packs along a path, said main conveyor being vertically below and spaced apart from said conveying device, said main conveyor having a conveying branch arranged for conveying said packs and said conveying device having an active branch along which said at least one pushing element interacts with said packs, said active branch of said conveying device facing said conveying branch of said main conveyor so that said at least one pushing element pushes said at least one flap while said packs are carried by said main conveyor, wherein said conveying device comprises first driving means arranged for interacting with second driving means of said main conveyor so that, in use, said main conveyor drives said conveying device.

2. The folding unit according to claim 1, wherein said at least one pushing element is movable with respect to said conveying device.

3. The folding unit according to claim 2, wherein said conveying device comprises at least one resilient element interposed between said at least one pushing element and said conveying device.

4. The folding unit according to claim 1, wherein said at least one pushing element includes a plurality of pushing devices and said conveying device comprises a chain conveyor provided with link elements, at least some of said link elements carrying a respective pushing device of said plurality of pushing devices.

5. The folding unit according to claim 4, wherein the number of said pushing devices is one half of the number of said link elements, said pushing elements being arranged along said chain conveyor and being associated to every second link element of said link elements.

6. The folding unit according to claim 4, wherein each pushing element of said plurality of pushing elements is hinged to a corresponding link element of said link elements.

7. The folding unit according to claim 4, wherein said conveying device comprises a plurality of resilient elements, each resilient element of said plurality of resilient elements being interposed between a corresponding pushing element of said plurality of pushing elements and a corresponding link element of said link elements.

8. The folding unit according to claim 1, further comprising a supporting structure comprising a fixed supporting plate facing towards said main conveyor, said at least one rolling element of said conveying device rolling on said fixed supporting plate while said at least one pushing element interacts with said at least one flap, said fixed supporting plate preventing said conveying device from moving away from said main conveyor while said at least one pushing element interacts with said at least one flap.

9. The folding unit according to claim 1, wherein said main conveyor comprises a plurality of links, said conveying device comprises a chain conveyor provided with link elements, and said links in said main conveyor having a same pitch as said link elements in said chain conveyor.

10. The folding unit according to claim 1, wherein said conveying device comprises a chain conveyor provided with link elements, and said first driving means comprises a plurality of appendixes, at least some of said link elements carrying a respective appendix of said plurality of appendixes.

11. The folding unit according to claim 10, wherein the number of said appendixes is one half of the number of said link elements, said appendixes being associated to every second link element of said link elements, so that said appendixes and said pushing elements are staggered on said chain conveyor.

12. The folding unit according to claim 10, wherein said second driving means comprises a plurality of cavities of said main conveyor, said cavities being arranged for receiving said appendixes.

13. A folding unit for producing a package from a sealed pack having at least one unfolded flap, said folding unit comprising:

a chain conveyor comprising link elements and rollers connected to said link elements, said chain conveyor rotating in a closed loop, the closed loop possessing a curved top portion and a linear bottom portion;

at least one pushing element configured to be conveyed by said conveyor, the at least one pushing element configured to contact and fold said at least one unfolded flap of said sealed pack;

said at least one pushing element comprising a bulge portion that protrudes beyond said chain conveyor and a spring that urges said bulge portion radially outward from said chain conveyor;

a fixed supporting plate positioned directly above said linear bottom portion of said closed loop, said fixed supporting plate possessing a bottom surface, said bottom surface being parallel to said linear bottom portion of said closed loop; and said rollers of said chain conveyor rolling along said fixed supporting plate when said at least one pushing element is being conveyed along said linear bottom portion.

14. A folding system for producing a package from a sealed pack having at least one unfolded flap, said folding system comprising:

a first conveyor for advancing the sealed pack along a path, the first conveyor being rotatable around a closed loop, the closed loop having a left side segment, a top segment, a right side segment and a bottom segment;

a second conveyor positioned vertically above a portion of the top segment of the first conveyor;

at least one pushing element configured to be conveyed by the second conveyor, the at least one pushing element configured to contact and fold the at least one unfolded flap of the sealed pack while the sealed pack is being advanced along the portion of the top segment of the closed loop of the first conveyor; and the at least one pushing element comprising a bulge portion that protrudes below the second conveyor when the at least one pushing element contacts and folds the at least one unfolded flap of the sealed pack.

15. The folding system according to claim 14, wherein the at least one pushing element comprises a spring that urges the bulge portion towards the first conveyor when the at least one pushing element contacts and folds the at least one unfolded flap of the sealed pack.

* * * * *